United States Patent [19]

Brooks

[11] 4,406,328

[45] Sep. 27, 1983

[54] APPARATUS FOR LOCKING A BALL VALVE ELEMENT IN ONE POSITION

[75] Inventor: Robert T. Brooks, Kingwood, Tex.

[73] Assignee: Baker International Corporation, Orange, Calif.

[21] Appl. No.: 291,002

[22] Filed: Aug. 7, 1981

[51] Int. Cl.[3] ..... E21B 34/14

[52] U.S. Cl. ..... 166/332; 166/240

[58] Field of Search ..... 166/331, 332, 334, 330, 166/333, 240

[56] References Cited

U.S. PATENT DOCUMENTS 4,289,165 9/1981 Fredd ..... 166/332 X 4,293,038 10/1981 Evans ..... 166/331

*Primary Examiner*—Stephen J. Novosad

*Assistant Examiner*—Michael Starinsky

*Attorney, Agent, or Firm*—Norvell & Associates

[57] ABSTRACT

A ball valve assembly is provided having an internally projecting pin on the actuating sleeve element for the ball valve which engages a recessed shoulder in the periphery of the valve to prevent accidental displacement of the ball valve from its fully open position.

4 Claims, 4 Drawing Figures

APPARATUS FOR LOCKING A BALL VALVE ELEMENT IN ONE POSITION

BACKGROUND OF THE INVENTION

1. FIELD OF THE INVENTION:

The invention relates to an improved ball valve assembly for subterranean wells of the type wherein a spherical ball, having a cylindrical fluid passage therethrough, is rotated relative to an annular valve seat through an angle of 90° to effect the shifting of the fluid passage from a position transverse to the bore of an annular valve seat to a position aligned with the bore of the annular valve seat.

2. DESCRIPTION OF THE PRIOR ART:

A ball valve is one of the most popular types of valves employed in subterranean wells for the control of fluid passing through a conduit. Ball valves are commonly found in safety valves and test trees. For example, a pair of typical ball valves for a test tree are described and illustrated in my co-pending application, Ser. No. 064,455, filed Aug. 6, 1979, now U.S. Pat. No. 4,306,623, entitled "Valve Assembly For A Subterranean Well Conduit", and assigned to the Assignee of this application.

A typical ball valve embodies a spherically shaped element having a fluid passage through its center. An annular seal cooperates with a spherical segment portion of the surface of the ball valve and maintains sealing relationship with the ball valve, particularly when it is shifted to its closed position wherein the fluid passage through the valve is disposed transversely to the bore of the annular seal, hence, closing the fluid conduit in which the valve is mounted. Ball valves are customarily operated by a camming sleeve or by a pair of diametrically opposed camming sleeve segments, which incorporate cam slots which respectively receive radially projecting, diameterically opposed pins projecting from the periphery of the ball valve and offset from the center thereof. Axial movement of the camming sleeve or sleeve segments thus effects a 90° rotation of the ball valve required to move it from a fully opened to a fully closed position.

With a ball valve of the type described and illustrated in the aforementioned co-pending application, it has been observed that when the valve is shifted to its fully opened position, the valve is subject to displacement from the fully opened position through impacts received from wire lines and tools suspended from such wire lines, which are inserted through the central fluid passage of the ball valve. Any such movement of the ball valve from a fully opened position can interfere with the subsequent removal of the wire line tool, and hence it is desirable that the ball valve, once it is moved to an opened position, be locked in such opened position, at least to the extent that it is not subject to displacement by impacts received from wire line tools passing therethrough.

SUMMARY OF THE INVENTION

In accordance with this invention, a flat surface or shoulder is provided on the ball valve which, as the ball valve is rotated 90° from its closed position to its fully opened position, also rotates. The camming sleeve or annular camming segment, as the case may be, which effects the rotation of the ball valve is provided with an inwardly projecting element or stop pin which is engaged by the aforementioned shoulder surface of the ball valve when it arrives at its fully opened position. By virtue of such engagement, any acidental impacts on the ball valve received from work strings passing therethrough will not effect any displacement of the ball valve, and the ball valve will remain in its fully opened position until the camming sleeve is axially shifted to effect the rotation of the ball to its closed position.

DESCRIPTION OF THE PREFERRED EMBODIMENTS

Figure 1:
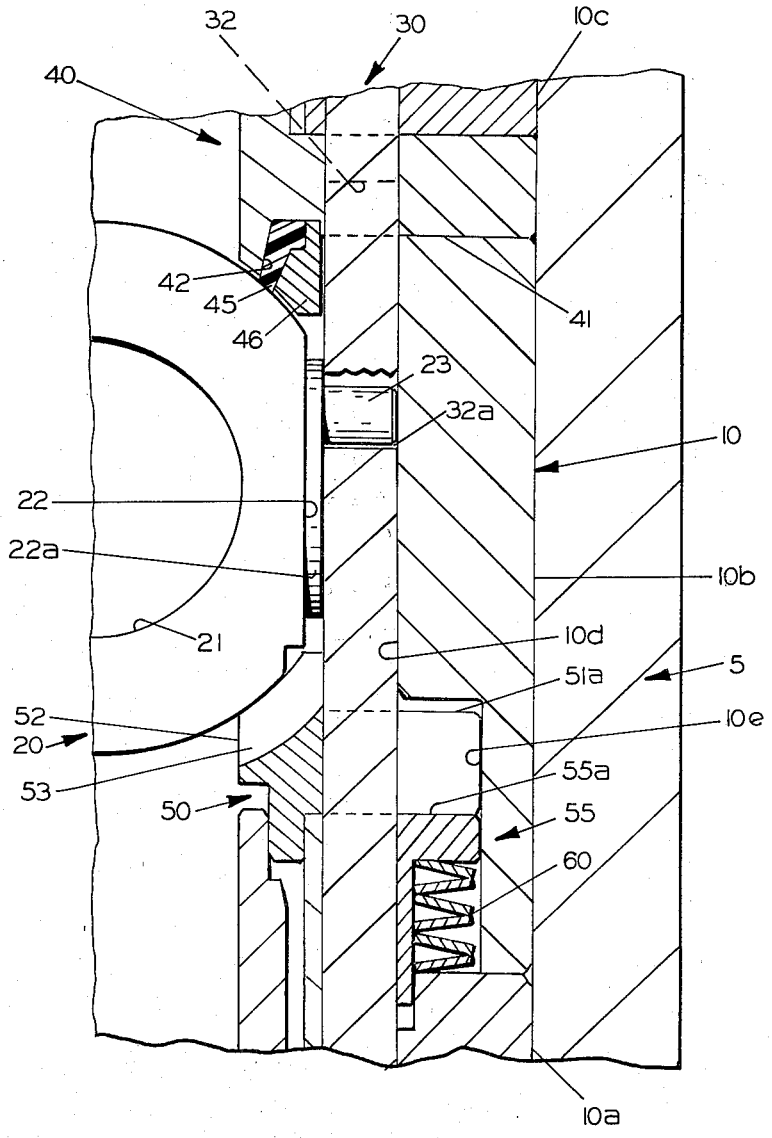
FIG. 1 is a vertical sectional view of a ball valve assembly embodying this invention, with the ball valve shown in its closed position.

Referring to the drawings, the ball valve unit embodying this invention is mounted within a vertically disposed cylindrical housing 10 which, in turn, is conventionally secured in a ball cartridge receptacle 5. The housing 10 is preferably fabricated by the vertical stacking of a plurality of annular units 10*a*, 10*b*, and 10*c*. All such units define a common bore 10*d*, within which the ball valve unit 20 and a pair of diametrically opposed, actuating sleeve segments 30 are mounted. For a more detailed description of the mounting of the housing 10 and actuating sleeve segments 30 in the ball valve cartridge 5, reference should be had to the abovementioned co-pending application, Ser. No. 064,455, now U.S. Pat. No. 4,306,623.

The ball 20 is of conventional spherical shape and defines a cylindrical fluid passage 21 through its central portion. In FIG. 1, the ball is shown in its closed position wherein the cylindrical passage 21 is disposed at right angles to the bore 10*d* of the fixed housing 10. Ball 20 is further provided on its opposed sides with cirular flat surfaces 22, said surfaces being respectively parallel to the axis of the ball fluid passage 21. Each circular flat surface 22 defines a peripheral cylindrical wall 22*a* which rides between appropriate guides 31 provided in the inner face of the ball operating sleeve segments 30.

Additionally, the ball 20 is provided with a pair of coaxial camming pins 23 which respectively project outwardly from the flat surfaces 22 but are offset from the axis of rotation of the ball 20 defined by the cylindrical wall surfaces 22*a*. The camming pins 23 respectively engage cam slots 32 provided in each of the actuating sleeve segments 30, as is more particularly described and illustrated in my aforementioned co-pending application. Each actuating sleeve segment 30 is provided at its upper end with a T-slot 35 for convenient engagement with an actuating sleeve (not shown) which may be axially shifted by a fluid pressure actuator (not shown).

The vertical position of the ball 20 within the bore 20*d* of the housing assemblage 10 is determined by an annular ball seat support member 40 which is provided with a pair of radially projecting ribs or extensions 41 which are respectively engageable between the middle housing unit 10*b*. and the upper housing unit 10*c*. The extensions 41 respectively project through the radial spaces defined between the opposed actuating sleeve segments 30. The bottom interior surface of the annular seal support 40 is recessed as indicated at 42, and an elastomeric seal element 45 is secured in such recess by a securing ring 46 which is suitably secured to the annular seal support 40 by a plurality of bolts (not shown). The bottom face of the annular elastomeric seal element 45 projects slightly beyond the adjacent surfaces of the seal support 40 and the retaining ring 46 so as to snugly engage a spherical segment portion of the ball 20 in its closed position illustrated in FIG. 1, and to maintain such sealing engagement as the ball is rotated 90° through the cooperation of the pivot pins 23 with the cam slots 32 of the actuating sleeve segments 30.

Figure 2:
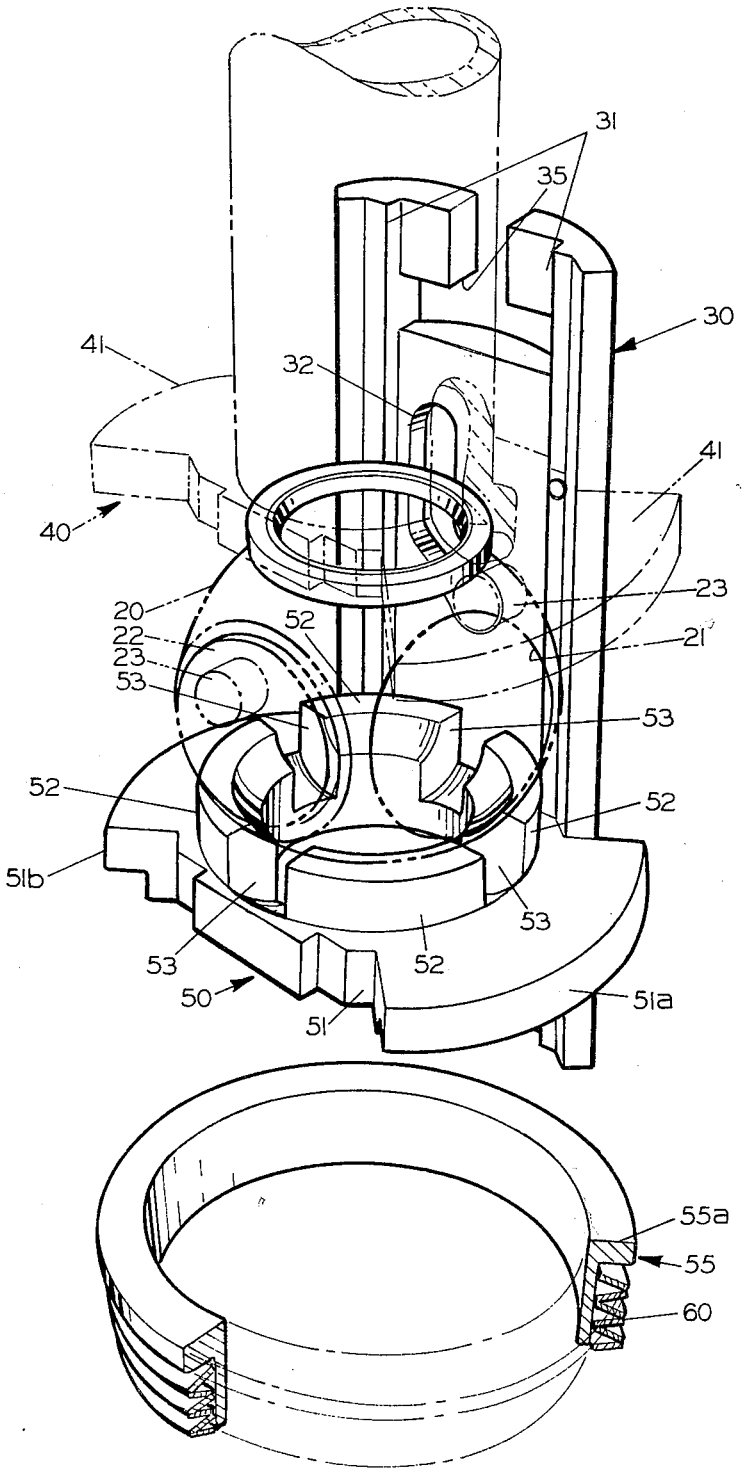
FIG. 2 is an exploded perspective view of the elements of the ball valve assembly of FIG. 1.

To provide a substantially constant loading between the elastomeric seal element 45 and the opposed spherical surface segment of the ball 20, an annular loading member 50 is provided below ball 20 which engages the side of the ball opposite to the point of engagement by the annular seal 45. As best shown in FIG. 2, the annular loading member 50 comprises a base porion 51 having oppositely disposed, radially projecting annular segment ribs 51*a* and 51*b* which are respectively disposed in the radial spaces between the actuating sleeve segments 30 and enter into an internal annular recess 10*e* (FIG. 1) provided in the lower portion of the central housing unit 10*b*. Four upstanding ball engaging annular segments 52 are then provided on the top surface of the base element 51, such segments being peripherally spaced apart to define grooves 53 therebetween for the passage of drilling mud or a kill fluid around the ball 20. The projecting annular segments 51*a* and 51*b* rest upon the top surface 55*a* of a spring guide 55 which is slidably mounted in the recess 10*e*. A plurality of annular disc springs 60 are then stacked beneath the spring guide 55 and abut against the top end wall of the lower housing sleeve section 10*a* to exert a preselected, constant upward force on the annular loading member 50 urging the ball 20 upwardly into sealing engagement with the elastomeric seal element 35.

Figure 4:
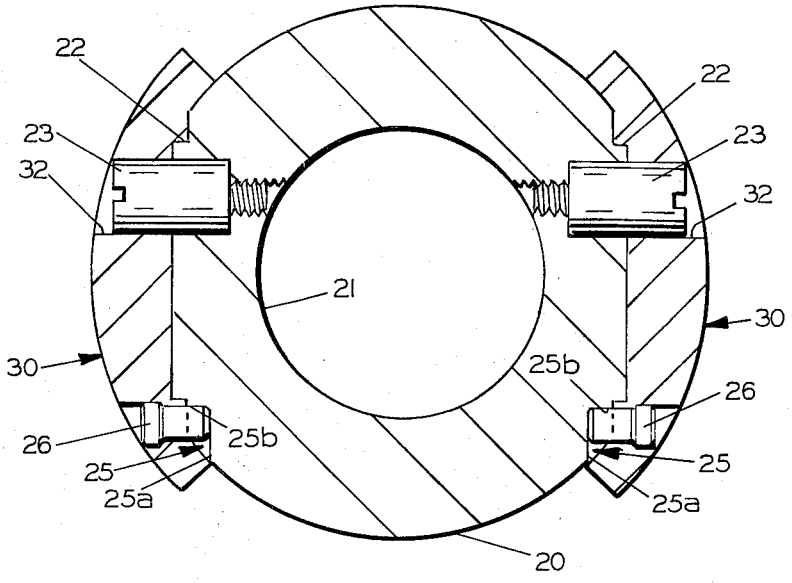
FIG. 4 is a view similar to FIG. 1 but showing the ball valve in its open position.
Figure 3:
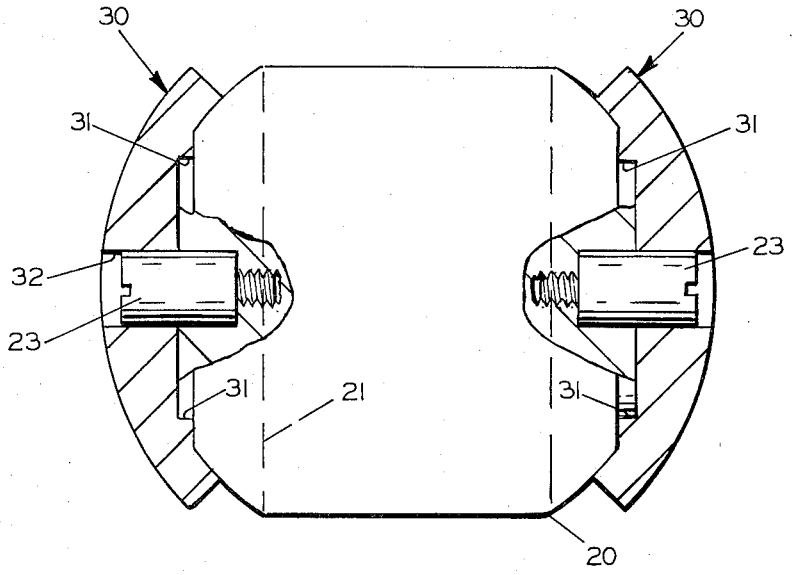
FIG. 3 is a horizontal sectional view through the ball element of FIG. 1.

Referring now particularly to FIG. 4, a right angle notch 25 is cut into one edge of each of the flat surfaces 22, thus defining wall surfaces 25*a* and 25*b* which are in a vertical position when the ball 20 is moved to its open position as shown in FIG. 4. A pair of stop pins 26 are then threaded into each of the actuating sleeve segments 30 in a position such that the stop pins respectively contact the vertical wall surfaces 25*b* of the notches 25 when the ball 20 is moved into its fully open position as illustrated in FIG. 4. In this position, the axes of the stop pins 26 are respectively horizontally aligned with the axes of the camming pins 23 and lie in the same radial plane. The result is that the ball 20 is effectively stopped or locked against any accidental displacement produced by passage of a work string or objects carried by the work string when the ball 20 is in its open position. On other hand, the initial upward movement of the actuating sleeve segments 30 to rotate the ball 20 back to its closed position will immediately effect the rotation of the stop pins 26 respectively out of engagement with the vertical wall surfaces 25*b*.

From the foregoing description, it will be readily apparent that the described arrangement provides a reliable locking stopping or of the ball valve in its open position against inadvertent or accidental displacement from such open position by a work string passing through the central fluid passage 21 of the ball. The locking mechanism does not, in any manner, interfere with the normal rotation of the ball valve between its open and closed positions.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A ball valve assembly for use in a subterranean well comprising: a spherical ball defining a cylindrical fluid passage therethrough; an annular seal sealingly cooperable with the spherical surface of said ball; a pair of diametrically opposed flat surfaces on said ball respectively parallel to the axis of said cylindrical fluid passage; each said flat surface having a cylindrical periphery defining the rotational axis of the ball; a pair of opposed coaxial ball rotating pins respectively mounted on said flat surfaces in offset relationship to the center of said ball; sleeve segment means respectively surrounding at least the flat surface portions of said ball and axially movable relative to said ball; said sleeve segments respectively defining vertical guides respectively receiving said cylindrical peripheries of said flat surface; a pair of camways respectively defined in the inner surfaces of said sleeve segment means and respectively receiving said ball rotating pins therein, whereby axial movement of said sleeve segment means shifts said ball 90° from an open position wherein said ball fluid passage is aligned with the bore of said annular seal to a closed position wherein said ball fluid passage is transverse to the bore of said annular seal; an inwardly extending shoulder formed on the edge of each ball flat surface parallel to the axes of said ball rotating pins; and a pair of opposed inwardly projecting abutments respectively engageable with said shoulders in the open position of said ball to stop said ball in said open position.

2. The ball valve assembly of claim 1 wherein said inwardly projecting abutments comprise pins threadably mounted in said sleeve means.

3. The ball valve assembly of claim 1 wherein the positions of said inwardly projecting abutments in said shoulder engaging position are respectively in the same horizontal plane as said ball rotating pins.

4. The ball valve assembly of claim 3 wherein said inwardly projecting abutments comprise opposed pins having their axes lying in the same horizontal plane as the axes of said ball rotating pins when said ball is in its fully open position.

* * * * *